US010195726B2

(12) United States Patent
Truong et al.

(10) Patent No.: US 10,195,726 B2
(45) Date of Patent: Feb. 5, 2019

(54) DE-MATING APPARATUS

(71) Applicant: ION CORPORATION, Eden Prairie, MN (US)

(72) Inventors: Chung C. Truong, Eden Prairie, MN (US); Thomas P. Jones, II, Apple Valley, MN (US)

(73) Assignee: Ion Corporation, Eden Prairie, MN (US)

( * ) Notice: Subject to any disclaimer, the term of this patent is extended or adjusted under 35 U.S.C. 154(b) by 288 days.

(21) Appl. No.: 15/072,714

(22) Filed: Mar. 17, 2016

(65) Prior Publication Data

US 2016/0271773 A1 Sep. 22, 2016

Related U.S. Application Data

(60) Provisional application No. 62/136,246, filed on Mar. 20, 2015.

(51) Int. Cl.
*B25B 27/02* (2006.01)

(52) U.S. Cl.
CPC ..... *B25B 27/02* (2013.01); *Y10T 29/53283* (2015.01)

(58) Field of Classification Search
CPC ... B25B 27/02; B25B 27/00; Y10T 29/49822; Y10T 29/53909; Y10T 29/53283
USPC ..... 29/764, 762, 729
See application file for complete search history.

(56) References Cited

U.S. PATENT DOCUMENTS 3,050,841 A * 8/1962 Esselstyn ..... H05K 13/0061 29/268
3,443,297 A * 5/1969 Lusby, Jr. ..... H05K 13/0491 29/239
3,516,142 A * 6/1970 Mottl ..... H05K 13/0007 29/741
4,468,858 A 9/1984 Gulberg et al.
4,604,796 A * 8/1986 Tsipenyuk ..... H01R 43/26 29/758
4,616,414 A * 10/1986 Cushman ..... B25J 15/0253 29/741
4,660,281 A * 4/1987 Omand ..... H05K 13/0491 29/758
4,805,298 A 2/1989 Takahashi
(Continued)

OTHER PUBLICATIONS

International Search Report and Written Opinion issued in PCT/US2016/022806, dated Jun. 16, 2016, 13 pages.

*Primary Examiner* — Peter DungBa Vo
*Assistant Examiner* — Kaying Kue
(74) *Attorney, Agent, or Firm* — Faegre Baker Daniels LLP

(57) ABSTRACT

A de-mating apparatus includes a first component, a second component and a pair of parallel linear bearings. The first component includes a first pair of arms, each of the first pair of arms including a first lift surface. The second component includes a second pair of arms, each of the second pair of arms including a second lift surface. The second lift surfaces are parallel to the first lift surfaces. The linear bearings connect the first component to the second component such that the first pair of arms may move perpendicularly to the first lift surfaces between at least a first position adjacent to the second pair of arms and a second position apart from the second pair of arms to de-mate an electrical connector assembly. A bearing plane defined by the pair of linear bearings does not intersect the first pair of arms.

12 Claims, 8 Drawing Sheets

(56) References Cited

U.S. PATENT DOCUMENTS

| | | | | | |
|---|---|---|---|---|---|
| 4,817,274 | A | | 4/1989 | Higgins | |
| 4,961,256 | A | | 10/1990 | Faillace | |
| 5,108,140 | A | | 4/1992 | Bartholet | |
| 5,193,269 | A | * | 3/1993 | Dattilo | H05K 13/0491 29/741 |
| 5,425,169 | A | * | 6/1995 | Steinman | B25B 27/02 29/267 |
| 5,502,887 | A | * | 4/1996 | Gonzales | H05K 13/0491 29/758 |
| 5,509,821 | A | | 4/1996 | Small et al. | |
| 5,842,261 | A | * | 12/1998 | Ortiz | B25B 27/023 29/426.5 |
| 2003/0229979 | A1 | * | 12/2003 | Kappel | B25B 27/02 29/426.6 |
| 2004/0168309 | A1 | * | 9/2004 | Aluffo | H01R 43/048 29/764 |
| 2006/0179646 | A1 | * | 8/2006 | Xie | H01R 43/048 29/750 |
| 2017/0292973 | A1 | * | 10/2017 | Chen | G01R 1/0466 |

* cited by examiner

DE-MATING APPARATUS

CROSS-REFERENCE TO RELATED APPLICATION

This application claims priority to U.S. Provisional Application No. 62/136,246 filed Mar. 20, 2015, which is herein incorporated by reference in its entirety.

TECHNICAL FIELD

The present invention relates to an apparatus for separating, or de-mating, electrical connectors. More specifically, the invention relates to an apparatus and method for de-mating multi-pin electrical connectors having tubular shells.

BACKGROUND

Multi-pin electrical connector assemblies having tubular shells are frequently employed in applications requiring highly reliable, multi-channel electrical connections. Such connector assemblies include a plug connector including an array of pins, and a socket connector including an array of sockets corresponding to the array of pins. The array of pins and the array of sockets are each axially surrounded by corresponding tubular shells. The corresponding tubular shells may be sized such that one shell nests snugly within the other forming an interference fit when the connectors are assembled, or mated, to form the multi-channel electrical connection. Thus, the shells may serve to protect the pins and sockets from damage and aid in aligning the pins and sockets when forming the electrical connection.

In some multi-pin electrical connector assemblies, the tubular shells are shaped such that the plug and socket connectors can be joined in only one configuration. One such multi-pin connector assembly is a D-subminiature connector assembly (D-sub). The tubular shells on the D-sub plug and socket connectors are shaped to have long sides of unequal length, joined by short sides that are not perpendicular to the long sides, thus producing a roughly trapezoidal, or D-like, axial cross-section. Attempts to join D-sub plug and socket connectors in an improper orientation generally result in harmless contact between the mismatched ends of tubular shells, while the more fragile pins and sockets remain undamaged.

Some multi-pin electrical connector assemblies, such as D-sub connector assemblies, also include a pair of retaining flanges that project away from the short sides of the tubular shells at the base of the shells. The retaining flanges may have holes through which screws or other retaining devices may pass to secure the plug and socket connectors to each other, preventing accidental disconnection of the multi-channel electrical connection. Once connected, a gap the size of the axial length of the longer of the tubular shells is formed between the retaining flanges of the joined plug and socket connectors.

De-mating the plug and socket connectors, once the screws or other retaining devices are removed, requires overcoming a retaining force resulting from the interference fit between the shells. Frequently, this is done by a technician grabbing one or both of the plug and socket connectors and/or inserting fingers partly into the gap between the retaining flanges, and rocking them back and forth until the plug and socket connectors separate. This rocking action can cause bent pins, damaged sockets, and scored electrical connector assemblies. Such damage may lead to a reduction in the expected high reliability of the multi-pin electrical connector assembly. Furthermore, the technician may suffer hand and finger injuries over time as a result of exposure to the sharp edges of the flanges and effort required to overcome the retaining force of the interference fit. A solution is needed that protects both the technician and the multi-pin electrical connector assembly.

SUMMARY

In Example 1, an apparatus for de-mating an electrical connector assembly includes a first component, a second component, and a pair of parallel linear bearings. The first component includes a first pair of arms projecting away from the first component. Each of the first pair of arms includes a first lift surface. The second component includes a second pair of arms projecting away from the second component. Each of the second pair of arms includes a second lift surface. The second lift surfaces are parallel to the first lift surfaces. The pair of linear bearings slideably connects the first component to the second component such that the first pair of arms may move perpendicularly to the first lift surfaces between at least a first position adjacent to the second pair of arms and a second position apart from the second pair of arms to de-mate the electrical connector assembly. A bearing plane defined by the pair of linear bearings does not intersect the first pair of arms.

In Example 2, the apparatus of Example 1, in which at least one of the first pair of arms and the second pair of arms further includes a pair of contact surfaces. Each of the pair of contact surfaces is disposed on one of the arms and faces toward and is spaced apart from the other of the pair of contact surfaces to form a gap between the pair of contact surfaces. The gap corresponds to a shape of a component of a tubular shell of the electrical connector assembly.

In Example 3, the apparatus of Example 1, in which at least one of the first pair of arms and the second pair of arms further includes a pair of contact surfaces. Each of the pair of contact surfaces disposed on one of the arms and facing toward and spaced apart from the other of the pair of contact surfaces to form a gap between the pair of contact surfaces, wherein the gap increases in a direction extending perpendicularly from the bearing plane, and the gap at a distance from the bearing plane corresponds to a shape of a component of a tubular shell of the electrical connector assembly.

In Example 4, the apparatus of any of Examples 1-3, in which at least one of the first pair of arms and the second pair of arms further includes a plurality of pairs of contact surfaces. Each of the contact surfaces of a pair of contact surfaces is disposed on one of the arms, faces toward the other of the pair of contact surfaces, and is spaced apart from the other of the pair of contact surfaces to form a gap between the pair of contact surfaces. Each pair of contact surfaces forms a gap corresponding to a component of a tubular shell of an electrical connector assembly having a different shell size.

In Example 5, the apparatus of any of Examples 1-4, in which at least one of the first pair of arms and the second pair of arms further includes a raised edge projecting from the first lift surface or the second lift surface. The raised edge forms a shape corresponding to a component of a retaining flange of the electrical connector assembly.

In Example 6, the apparatus of any of Examples 1-5, in which at least one of the first pair of arms and the second pair of arms further includes a plurality of pairs of raised edges. Each of the pairs of raised edges is projecting from the first lift surface or the second lift surface. Each of the pairs of raised edges forms a shape corresponding to a component of a retaining flange of an electrical connector assembly having a different retaining flange size.

In Example 7, the apparatus of any of Examples 1-6, in which the first component further includes a third pair of arms on a side of the first component opposite the first pair of arms and the third pair of arms projects away from the first component. Each of the third pair of arms including a third lift surface. The second component further includes a fourth pair of arms on a side of the second component opposite the second pair of arms. The fourth pair of arms projects away from the second component. Each of the fourth pair of arms including a fourth lift surface. The fourth lift surfaces are parallel to the third lift surfaces, such that the third pair of arms may move perpendicularly to the fourth lift surfaces between at least a first position adjacent to the fourth pair of arms and a second position apart from the fourth pair of arms to de-mate another electrical connector assembly. The bearing plane does not intersect the third pair of arms.

In Example 8, the apparatus of Example 7, in which at least one of the third pair of arms and the fourth pair of arms further includes a plurality of pairs of contact surfaces. Each of the contact surfaces of a pair of contact surfaces is disposed on one of the arms, faces toward the other of the pair of contact surfaces, and is spaced apart from the other of the pair of contact surfaces to form a gap between the pair of contact surfaces. Each pair of contact surfaces forms a gap corresponding to a component of a tubular shell of an electrical connector assembly having a different shell size.

In Example 9, the apparatus of any of Examples 7-8, in which at least one of the third pair of arms and the fourth pair of arms further includes a plurality of pairs of raised edges, the pairs of raised edges projecting from the third lift surface or the fourth lift surface, wherein each of the pairs of raised edges forms a shape corresponding to a component of a retaining flange of an electrical connector assembly having a different retaining flange size.

In Example 10, the apparatus of any of Examples 1-9, further including a biasing member disposed between the first component and the second component, in which the biasing member applies a biasing force between the first component and the second component in a direction causing the apparatus to be in the first position.

In Example 11, the apparatus of Example 12, further including means for adjusting the biasing force applied by the biasing member.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1A:
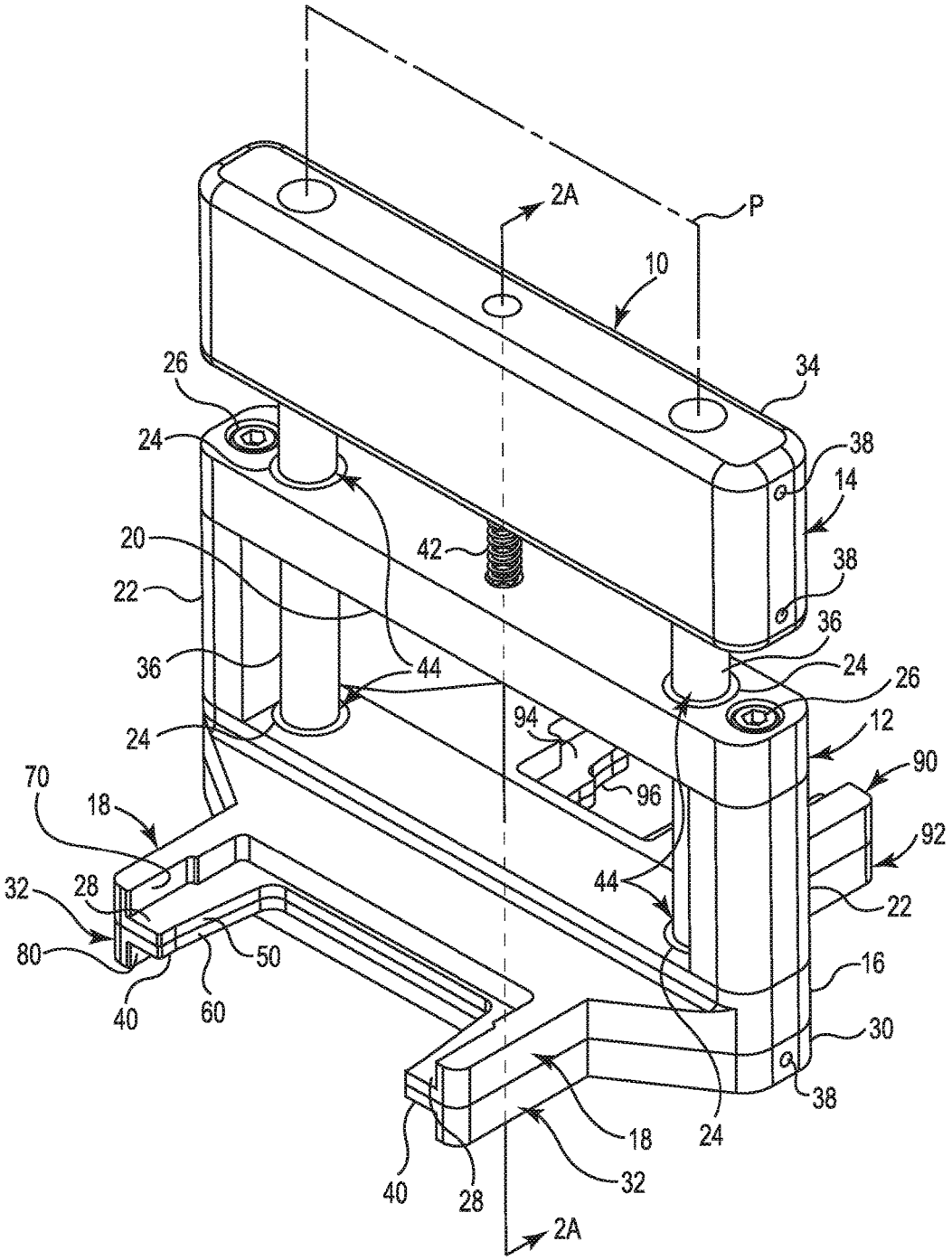
FIGS. 1A and 1B are perspective views of an exemplary de-mating apparatus.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

A more complete understanding of the present invention is available by reference to the following detailed description of numerous aspects and embodiments of the invention. The detailed description of the invention which follows is intended to illustrate, but not limit, the invention.

Figure 1B:
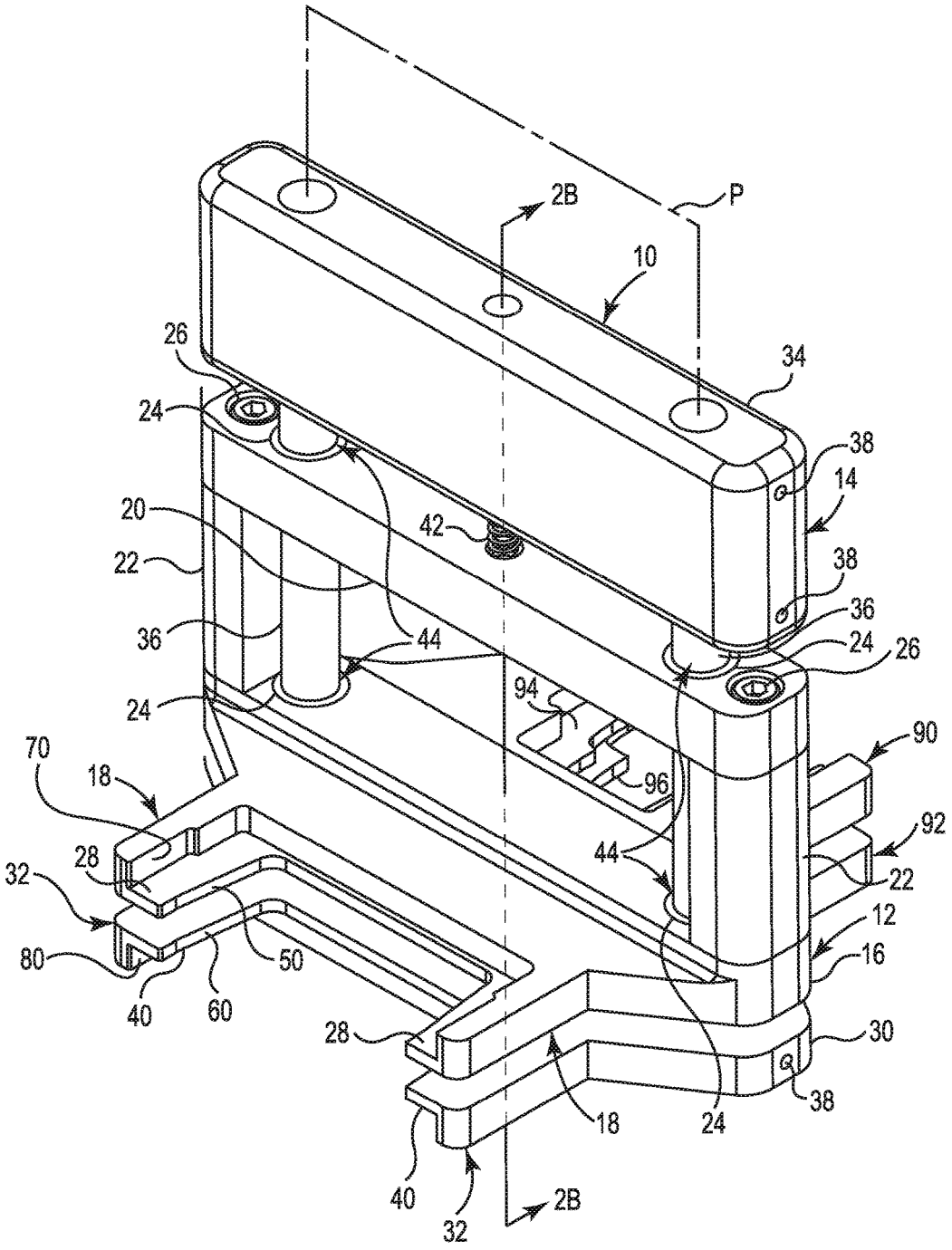

FIGS. 1A and 1B are perspective views of an exemplary de-mating apparatus. FIG. 1A shows a de-mating apparatus 10 in a first position. FIG. 1B shows the de-mating apparatus 10 in a second position. As shown in FIGS. 1A and 1B, the de-mating apparatus 10 may include a first component 12 and a second component 14. The first component 12 may include a first base 16, a first pair of arms 18, a first handle 20, two side posts 22, four bearing sleeves 24, and four screws 26 (two shown). The first pair of arms 18 projects away from the first component 12 at the first base 16. Each of the first pair of arms 18 may include a first lift surface 28. The second component 14 may include a second base 30, a second pair of arms 32, a second handle 34, two rods 36, and six set screws 38 (three shown). The second pair of arms 32 projects away from the second component 14 at the second base 30. Each of the second pair of arms 32 may include a second lift surface 40. The second lift surfaces 40 may be parallel to the first lift surfaces 28. The second pair of lift surfaces 40 may be aligned with the first pair of lift surfaces 28 in a direction perpendicular to first lift surfaces 28. Together, the four bearing sleeves 24 and the two rods 36 may form a pair of parallel linear bearings 44 that slideably connect the first component 12 to the second component 14, as described below in reference to FIGS. 2A and 2B. The pair of linear bearings 44 may define a bearing plane P. The pair of linear bearings 44 slideably connect the first component 12 to the second component 14 such that the first pair of arms 18 may move in a direction perpendicular to the first lift surface 28 between at least the first position adjacent to the second pair of arms 32, as shown in FIG. 1A, and a second position apart from the second pair of arms 32, as shown in FIG. 1B.

The de-mating apparatus 10 may further include a biasing member 42 disposed between the first component 12 and the second component 14. The biasing member 42 may be a means for applying a biasing force between the first component 12 and the second component 14 in a direction causing de-mating apparatus 10 to be in the first position. The biasing member 42 may be or include any type of device able to exert the biasing force, for example a spring, such as a coil spring or a leaf spring, or an elastomeric device, or actuator such as an air cylinder-piston. The de-mating apparatus 10 may be sized such that a technician may grip the de-mating apparatus 10 by placing a palm against a side of the second handle 34 away from first handle 20, and curling fingers around a side of first handle 20 away from second handle 34. Once gripped in such a fashion, the technician may squeeze first handle 20 and second handle 34 together to move the first pair of arms 18 from the first position adjacent to the second pair of arms 32 to the second position apart from the second pair of arms 32 to de-mate an electrical connector assembly, as described further in reference to FIGS. 3A and 3B below. Relaxing the grip of first handle 20 and the second handle 34 permits biasing member 42 to return the de-mating apparatus 10 to the first position for use in de-mating another electrical connector assembly.

Figure 2B:
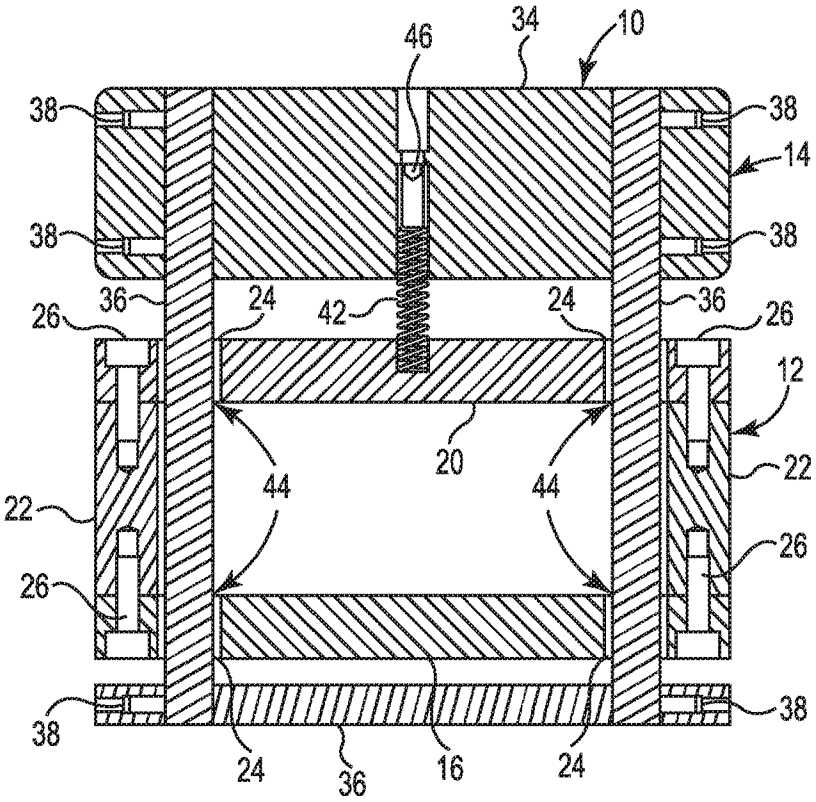
FIGS. 2A and 2B are cross-sectional views of the de-mating apparatus of FIGS. 1A and 1B.
Figure 2A:
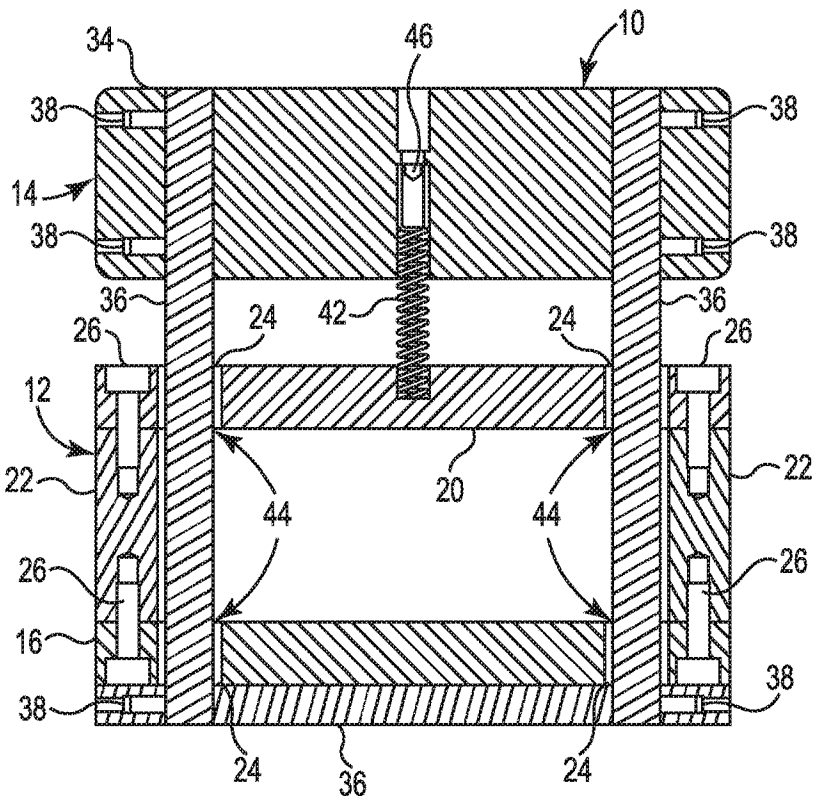

FIGS. 2A and 2B are cross-sectional views of the de-mating apparatus 10 shown in FIGS. 1A and 1B, respectively, taken along the bearing plane P. As show in FIGS. 2A and 2B, the first base 16 may be connected to the first handle 20 by the two side posts 22 and secured with the four screws 26. Two of the four bearing sleeves 24 are disposed in each of the first base 16 and the first handle 20 such that each of two bearing sleeves 24 in the first base 16 are axially aligned with a corresponding bearing sleeve 24 in the first handle 20. The second base 30 may be connected to the second handle 34 by the two rods 36 and secured with the six set screws 38. Each of the two rods 36 are partially disposed within, and axially aligned with one of the bearing sleeves 24 in first base 16 and the corresponding one of the bearing sleeves 24 in the first handle 20. As noted above, the four bearing sleeves 24 and the two rods 36 may form the pair of linear bearings 44 that slideably connect the first component 12 to the second component 14, such that the first component 12 may move between the first position shown in FIG. 2A, and the second position shown in FIG. 2B. The de-mating apparatus 10 may further include adjustable screw 46 such that the biasing force applied by biasing member 42 may be adjustable.

Most of the de-mating apparatus 10 may be made of aluminum to provide for a relatively light-weight apparatus. In the embodiment described above, the bearing sleeves 24 may be made of, for example, bronze; and the rods 36 may be made of, for example, stainless steel to provide a smooth, seamless motion between the first component 12 and the second component 14. Although the embodiment described above includes the pair of linear bearings 44 including rods 36 and bearing sleeves 24, it is understood that in other embodiments, the pair of linear bearings may be any type of linear bearing, for example, linear bearings incorporating roller bearings or guide rails.

FIGS. 1A and 1B also show that the first pair of arms 18 may further include a pair of contact surfaces 50 (one visible in FIGS. 1A and 1B). Each of the contact surfaces 50 may be disposed on one of each of the first pair of arms 18 and face the other of the contact surfaces 50 to form a gap between the pair of contact surfaces 50. Alternatively, or additionally, the second pair of arms 32 may further include a pair of contact surfaces 60 (one visible in FIGS. 1A and 1B). Each of the contact surfaces 60 may be disposed on one of each of the second pair of arms 18 and face the other of the contact surfaces 60 to form a gap between the pair of contact surfaces 60. At least one of the gap between the pair of contact surfaces 50 and the gap between the pair of contact surfaces 60 may correspond to a shape of a component of a tubular shell of an electrical connector assembly to be de-mated by de-mating apparatus 10.

Alternatively or additionally, the first pair of arms 18 may further include a pair of raised edges 70 (one visible in FIGS. 1A and 1B). Each of the raised edges 70 projects from the first lift surface 28. Alternatively, or additionally, the second pair of arms 32 may further include a pair of raised edges 80 (one visible in FIGS. 1A and 1B). Each of the raised edges 80 projects from the second lift surface 40. At least one of the raised edges 70 and the raised edges 80 forms a shape corresponding to a component of a retaining flange of an electrical connector assembly to be de-mated by de-mating apparatus 10.

Figure 4:
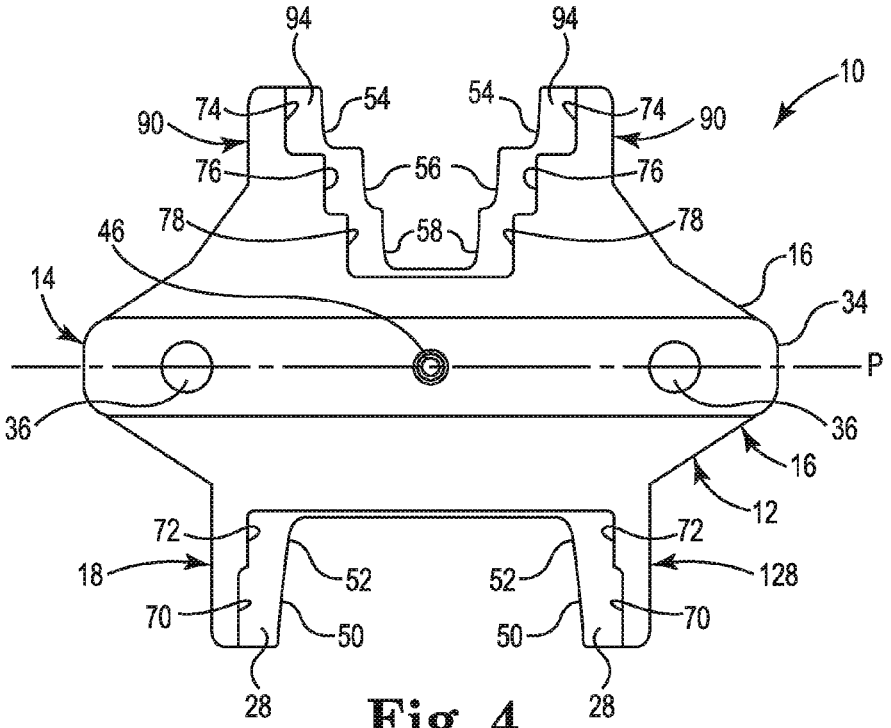
FIG. 4 is a top view of the de-mating apparatus of FIGS. 1A and 1B.
Figure 5:
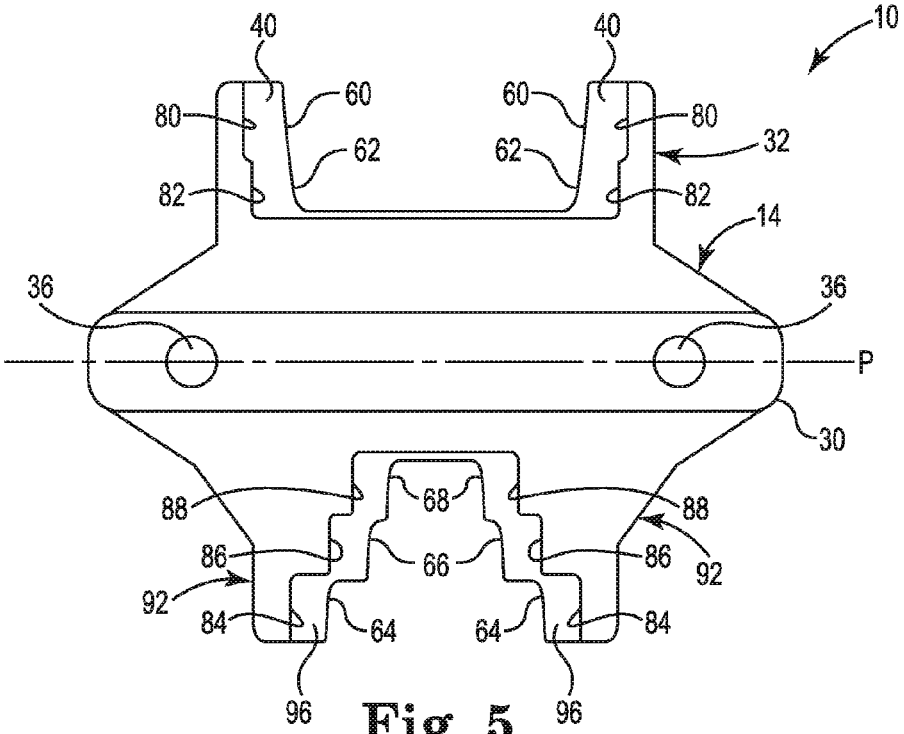
FIG. 5 is a bottom view of the de-mating apparatus of FIGS. 1A and 1B.

As shown in FIGS. 1A and 1B, the first component 12 may also further include a third pair of arms 90 including a third lift surface 94 on each of the third pair of arms 90; and the second component 14 may further include a fourth pair of arms 92 including a fourth lift surface 96 on each arm of the fourth pair of arms 92 to accommodate additional shell sizes, as described below in reference to FIGS. 4 and 5. The third pair of arms 90 projects away from the first component 12 at the first base 16 on a side of first component 12 opposite the first pair of arms 18. The fourth pair of arms 92 projects away from the second component 14 at the second base 30 on a side of the second component 14 opposite the second pair of arms 32. The fourth lift surfaces 96 may be parallel to the first lift surfaces 28 and the third lift surfaces 94. The fourth lift surfaces 96 may be aligned with the third lift surfaces 94 in a direction perpendicular to third lift surfaces 94.

Figure 3A:
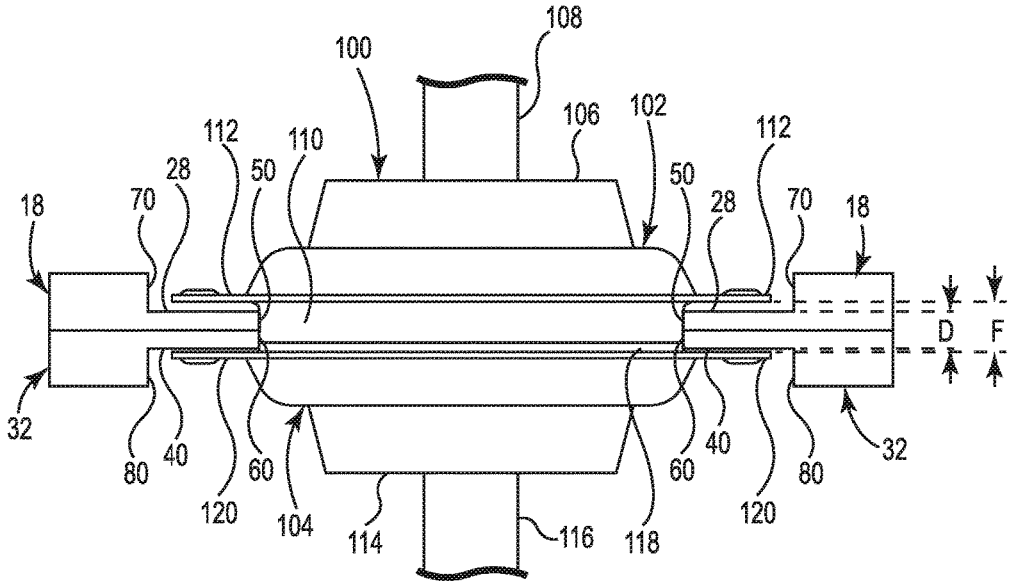
FIGS. 3A and 3B are front views illustrating the de-mating apparatus of FIGS. 1A and 1B de-mating an electrical connector assembly.
Figure 3B:
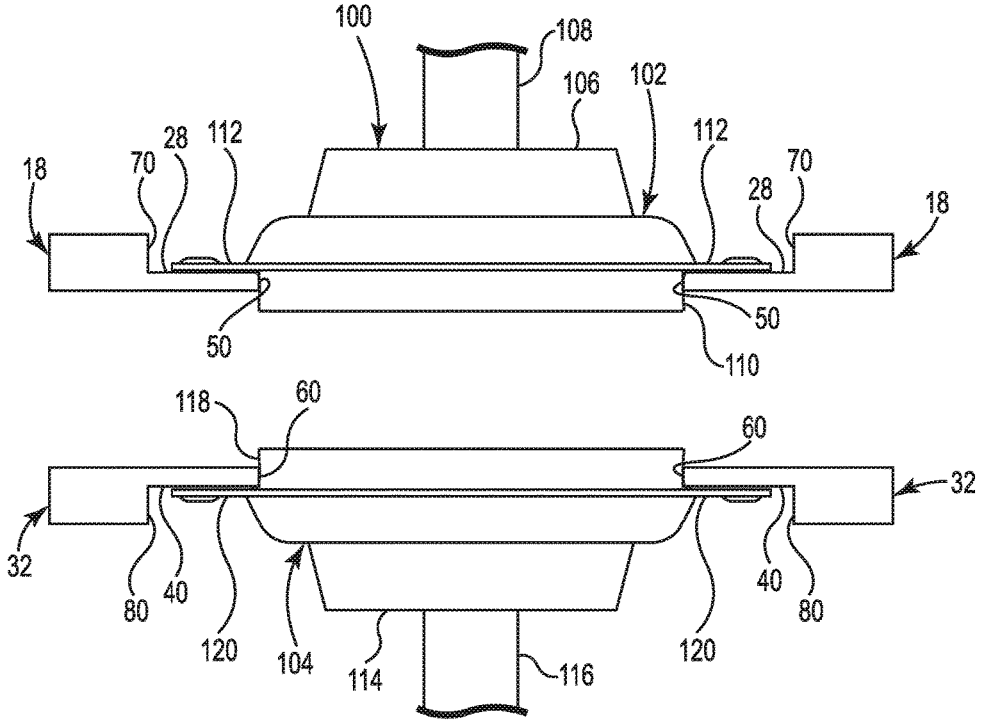

The operation of de-mating apparatus 10 to de-mate an electrical connector assembly is further illustrated in FIGS. 3A and 3B. FIGS. 3A and 3B are front views illustrating the de-mating apparatus 10 of FIGS. 1A and 1B de-mating an electrical connector assembly 100. For clarity, only the first pair of arms 18 and the second pair of arms 32 of the de-mating apparatus 10 are shown. FIG. 3A shows the de-mating apparatus 10 in the first position in which the first pair of arms 18 is adjacent to the second pair of arms 32 and engaging the electrical connector assembly 100 in a mated condition. FIG. 3B shows the de-mating apparatus 10 in the second position in which the first pair of arms 18 is apart from the second pair of arms 32 and engaging the electrical connector assembly 100 in a de-mated condition.

As shown in FIGS. 3A and 3B, the electrical connector assembly 100 may include a plug connector 102 mated and de-mated, respectively, to a socket connector 104. The plug connector 102 may contain a plurality of pins (not shown) and the socket connector 104 may contain a corresponding plurality of sockets (not shown) for engaging the plurality of pins to form a multi-pin electrical connection. The plug connector 102 may include a plug connector body 106, a plug wire bundle 108, a plug tubular shell 110, and plug retaining flanges 112. The plug wire bundle 108 may be connected to the plug connector body 106 and may include a plurality of wires (not shown) providing electrical paths to the plug connector 102. The plug connector body 106 may house electrical connections between the plurality of wires and the plurality of pins. The plug tubular shell 110 may project from the plug connector body 106 to axially surround a portion of the plurality of pins that may engage the plurality of sockets in socket connector 104. The plug retaining flanges 112 may project away from opposite sides of the plug tubular shell 110 where the plug tubular shell 110 projects from the plug connector body 106.

The socket connector 104 may include a socket connector body 114, a socket wire bundle 116, a socket tubular shell 118, and socket retaining flanges 120. The socket wire bundle 116 may be connected to the socket connector body 114 and may include a plurality of wires (not shown) providing electrical paths to the socket connector 104. The socket connector body 114 may house electrical connections between the plurality of wires and the plurality of sockets.

The socket tubular shell 118 may project from the socket connector body 114 to axially surround a portion of the plurality of sockets that may engage the plurality of pins in pin connector 102. The socket retaining flanges 120 may project away from opposite sides of the socket tubular shell 118 where the socket tubular shell 118 projects from the socket connector body 114.

In the embodiment shown in FIGS. 3A and 3B, the gap between the pair of contact surfaces 50 may correspond to a shape of the plug tubular shell 110 and the gap between the pair of contact surfaces 60 may correspond to a shape of the socket tubular shell 118. Further, the raised edges 70 may form a shape corresponding to the retaining flanges 112, and the raised edges 80 may form a shape corresponding to the retaining flanges 120.

As shown in FIG. 3A, when the de-mating apparatus 10 in the first position in which the first pair of arms 18 is adjacent to the second pair of arms 32, the first lift surface 28 is spaced from the second lift surface 40 by a distance D. The electrical connector assembly 100 in a mated condition has a gap F between the plug retaining flange 112 and the socket retaining flange 120. Gap F may be greater than distance D such that the de-mating apparatus 10 may engage the mated electrical connector assembly 100, as shown in FIG. 3A. So engaged, the first lift surface 28 of one of the first pair of arms 18 and the corresponding second lift surface 40 of the corresponding one of the second pair of arms 32 are interposed between the plug retaining flange 112 and the socket retaining flange 120 on one side of the electrical connector assembly 100; and the first lift surface 28 of the other one of the first pair of arms 18 and the corresponding second lift surface 40 of the corresponding other one of the second pair of arms 32 are interposed between the plug retaining flange 112 and the socket retaining flange 120 on the opposite side of the electrical connector assembly 100. In some embodiments, gap F may be, for example, about 0.24 to 0.28 inches (6.1 to 7.1 mm) and distance D may be, for example, about 0.18 to 0.22 inches (4.6 to 5.6 mm).

The de-mating apparatus 10 may further engage the mated electrical connector assembly 100 such that the plug tubular shell 110 physically contacts the pair of contact surfaces 50, and/or the socket tubular shell 118 physically contacts the pair of contact surfaces 60. In this way, each of the first lift surfaces 28 and the plug retaining flanges 112; and the second lift surfaces 40 and the socket retaining flanges 120 may present the largest possible area for engagement.

Once engaged, the de-mating apparatus 10 may de-mate the electrical connector assembly 100 as shown in FIG. 3B by moving the first pair of arms 18 from the first position adjacent to the second pair of arms 32 to the second position apart from the second pair of arms 32 as described above in reference to FIGS. 1A and 1B. Because the pair of linear bearings 44 direct the movement of the first pair of arms 18 in a direction perpendicular to the first lift surfaces 28, and the second lift surfaces 40 may be parallel to the first lift surfaces 28, as describe above in reference to FIGS. 1A and 1B, the force to de-mate the electrical connector assembly 100 may be applied evenly, in a direction parallel to the axis of the plug tubular shell 110 and the socket tubular shell 118, with no rocking of the electrical connector assembly 100.

In the embodiment shown in FIGS. 3A and 3B, it may be the physical contact between the plug tubular shell 110 and the pair of contact surfaces 50, and/or between the socket tubular shell 118 and the pair of contact surfaces 60 that determines the engagement of the de-mating apparatus 10 with the electrical connector assembly 100. The pair of raised edges 70 and the pair of raised edges 80 may provide additional support and visual clues to aid in engaging the de-mating apparatus 10 with the electrical connector assembly 100, but they may not determine the engagement, as there may not be physical contact between edges of the plug retaining flanges 112 and pair of raised edges 70, or between edges of the socket retaining flanges 120 and the pair of raised edges 80.

In other embodiments, it may be the physical contact between edges of the plug retaining flanges 112 and pair of raised edges 70, and/or between edges of the socket retaining flanges 120 and the pair of raised edges 80 that determines the engagement of the de-mating apparatus 10 with the electrical connector assembly 100. The pair of contact surfaces 50, and/or the pair of contact surfaces 60 may provide additional support and visual clues to aid in engaging the de-mating apparatus 10 with the electrical connector assembly 100, but they may not determine the engagement, as there may not be physical contact between the plug tubular shell 110 and the pair of contact surfaces 50, and/or between the socket tubular shell 118 and the pair of contact surfaces 60.

Electrical connector assemblies to be de-mated by the de-mating apparatus 10 may come in various shell sizes. For example, multi-pin electrical connectors may come in shell sizes 1, 2, 3, 4, 5, or 6 which may be defined, for example, in Military Specification MIL-DTL-24308G. In some embodiments, de-mating apparatus 10 may be configured to de-mate a single shell size and at least one of the contact surfaces 50, contact surfaces 60, raised edges 70, and raised edges 80 may be sized to correspond to the single shell size. In other embodiments, such as that illustrated in FIGS. 1A and 1B, de-mating apparatus 10 may be configured to de-mate more than a single shell size. FIGS. 4 and 5 are a top view and a bottom view, respectively, of the de-mating apparatus 10 shown in FIGS. 1A and 1B and illustrating that the first pair of arms 18 may include the pair of contact surfaces 50 and the pair of raised edges 70; and the second pair of arms 32 may include the pair of contact surfaces 60 and the pair of raised edges 80 as described above in reference to FIGS. 1A and 1B. The gap formed between the pair of contact surfaces 50 and/or the pair of contact surfaces 60 may correspond to the shape of a component of a tubular shell and/or the shape formed by raised edges 70 and/or raised edges 80 may correspond to a retaining flange of a particular shell size, for example, shell size 4 (or size 6, which has the same relevant dimensions as size 4). FIG. 4 also shows that the first pair of arms 18 may further include a pair of contact surfaces 52 and a pair of raised edges 72; and the second pair of arms 32 may further include a pair of contact surfaces 62 and a pair of raised edges 82. A gap formed between the pair of contact surfaces 52 and/or the pair of contact surfaces 62 may correspond to the shape of a component of a tubular shell and/or the shape formed by raised edges 72 and/or raised edges 82 may correspond to a retaining flange of a different shell size, for example, shell size 5. So configured, the de-mating apparatus 10 may be able to de-mate electrical connectors assemblies of more than one shell size.

As described above, the gap formed between the pair of contact surfaces 50 and/or the pair of contact surfaces 60 may correspond to a shape of a component of a tubular shell. As previously noted, in some cases, the tubular shells may be shaped such that the plug and socket connectors can be joined in only one configuration. For example, the tubular shells on the D-sub plug and socket connectors are shaped to have long sides of unequal length, joined by short sides that are not perpendicular to the long sides, thus producing a roughly trapezoidal, or D-like, axial cross-section. As shown in FIGS. 4 and 5, the gap formed between the pair of contact surfaces 50 and/or the pair of contact surfaces 60 may increase in a direction extending perpendicularly from the bearing plane P such that the gap at a distance from the bearing plane P corresponds to a shape of a component of a tubular shell of the electrical connector assembly.

As noted above, in reference to FIGS. 1A and 1B, the first component 12 may include the third pair of arms 90 including the third lift surface 94 on each of the third pair of arms 90; and the second component 14 may include the fourth pair of arms 92 including the fourth lift surface 96 on each arm of the fourth pair of arms 92 to accommodate additional shell sizes. As shown in FIGS. 4 and 5, the third pair of arms 90 may further include a pair of contact surfaces 54 and a pair of raised edges 74; and the fourth pair of arms 92 may further include a pair of contact surfaces 64 and a pair of raised edges 84. A gap formed between the pair of contact surfaces 54 and/or the pair of contact surfaces 64 may correspond to the shape of a component of a tubular shell and/or the shape formed by raised edges 74 and/or raised edges 84 may correspond to a retaining flange of a different shell size, for example, shell size 3. The third pair of arms 90 may further include a pair of contact surfaces 56 and a pair of raised edges 76; and the fourth pair of arms 92 may further include a pair of contact surfaces 66 and a pair of raised edges 86. A gap formed between the pair of contact surfaces 56 and/or the pair of contact surfaces 66 may correspond to the shape of a component of a tubular shell and/or the shape formed by raised edges 76 and/or raised edges 86 may correspond to a retaining flange of a different shell size, for example, shell size 2. The third pair of arms 90 may further include a pair of contact surfaces 58 and a pair of raised edges 78; and the fourth pair of arms 92 may further include a pair of contact surfaces 68 and a pair of raised edges 88. A gap formed between the pair of contact surfaces 58 and/or the pair of contact surfaces 68 may correspond to the shape of a component of a tubular shell and/or the shape formed by raised edges 78 and/or raised edges 88 may correspond to a retaining flange of a different shell size, for example, shell size 1. Thus, as shown in FIGS. 4 and 5, the de-mating apparatus 10 may be able to de-mate electrical connector assemblies of at least five different shell sizes.

Considering FIGS. 1A, 1B, 3A, 3B, 4, and 5, engagement between the de-mating apparatus 10 and any electrical connector assembly may be at first pair of arms 18 and the second pair of arms 32, or at the third pair of arms 90 and the fourth pair of arms 92. The bearing plane P intersects all of the major components of the de-mating apparatus 10, including the first base 16, the first handle 20, the second base 30, the second handle 34, and the linear bearings 44. The bearing plane P does not intersect any of the first pair of arms 18, the second pair of arms 32, the third pair of arms 90, or the fourth pair of arms 92. So configured, the de-mating apparatus 10 permits an unobstructed view of an electrical connector assembly during the de-mating process, as shown in, for example, FIG. 4. In addition, the physical separation between the bearing plane P and any of the first pair of arms 18, the second pair of arms 32, the third pair of arms 90, or the fourth pair of arms 92 provides for unfettered passage of wire bundles, such as plug wire bundle 108 and socket wire bundle 116 discussed above in reference to FIGS. 3A and 3B.

Figure 6:
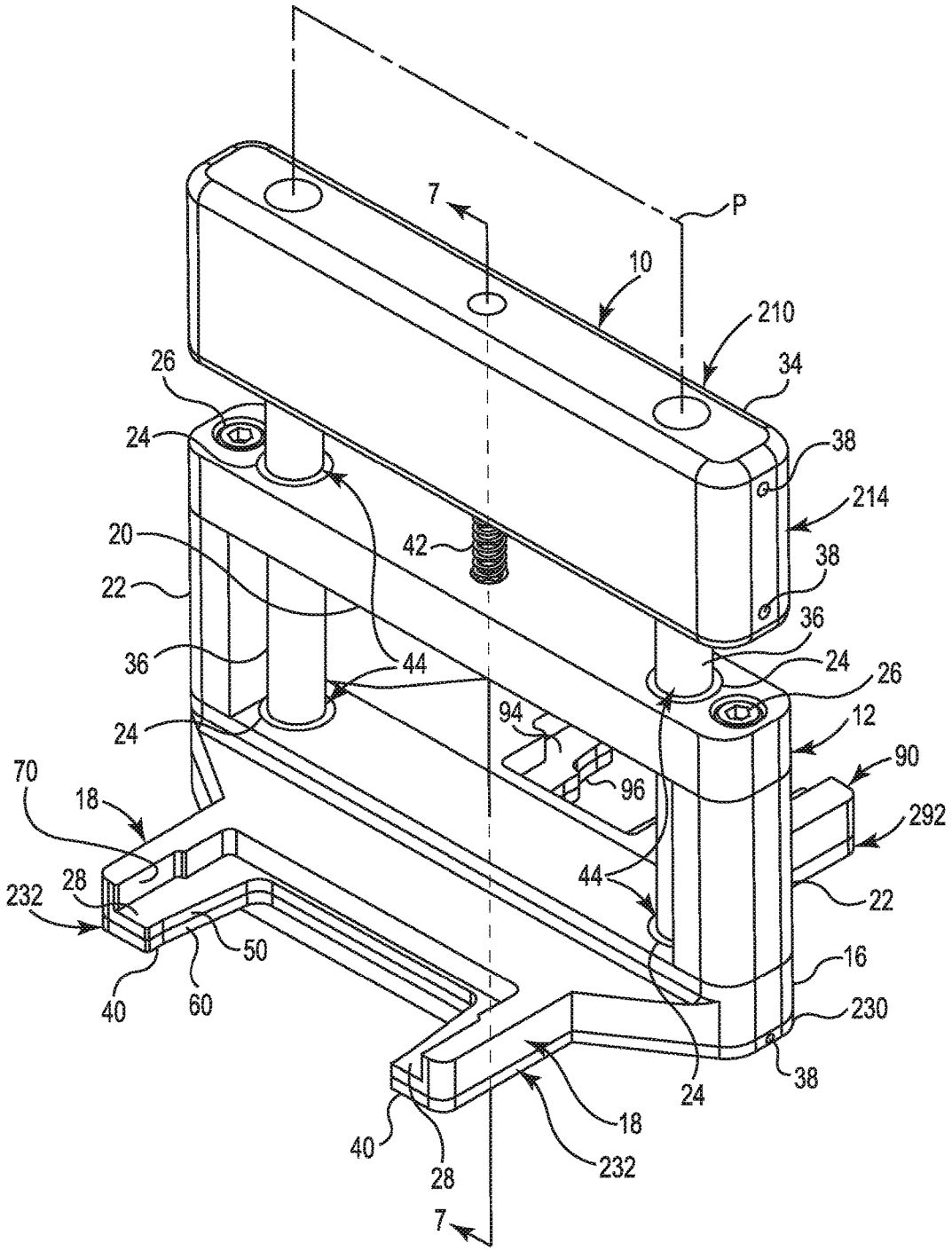
FIG. 6 is a perspective view of another exemplary de-mating apparatus.
Figure 7:
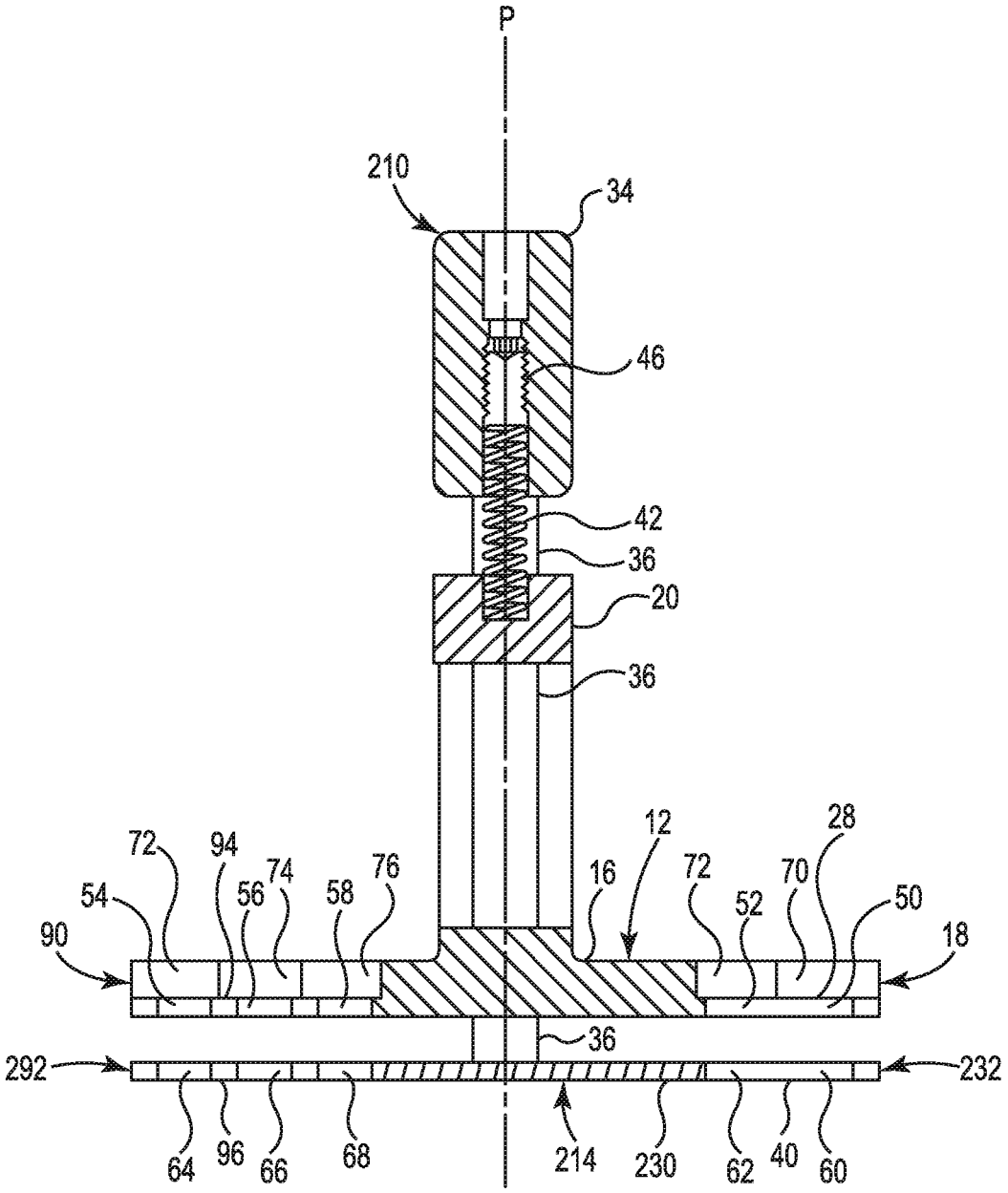
FIG. 7 is a cross-sectional view of the de-mating apparatus of FIG. 6.

FIG. 6 is a perspective view of another exemplary de-mating apparatus for de-mating an electrical connector assembly connected to a substantially flat surface, such as, for example, an electrical panel or circuit board. FIG. 6 shows a de-mating apparatus 210 in the first position as described below. FIG. 7 is a cross-sectional view of the de-mating apparatus 210 of FIG. 6. The de-mating apparatus 210 is shown in the second position, as described below. Considering FIGS. 6 and 7 together, the de-mating apparatus 210 may be identical to the de-mating apparatus 10 described above, except that the second component 14 may be replaced by a second component 214. The second component 214 may be identical to the second component 14 except that the second base 30 may be replaced by a second base 230 and the second pair of arms 32 and the fourth pair of arms 92 are replaced by a second pair of arms 232 and a fourth pair of arms 292. The second pair of arms 232 and the fourth pair of arms 292 are identical to the second pair of arms 32 and the fourth pair of arms 92 except that they do not include the raised edges 80 or 82 projecting from the second lift surface 40, or the raised edges 84, 86, or 88 projecting from the fourth lift surface 96. The second base 230 may be identical to the second base 30 except that the second base 230 may be thinner, so that in combination with the second pair of arms 232 and the fourth pair of arms 292, the de-mating apparatus 210 has a smooth, flat bottom for de-mating an electrical connector assembly connected to a substantially flat surface.

Figure 8A:
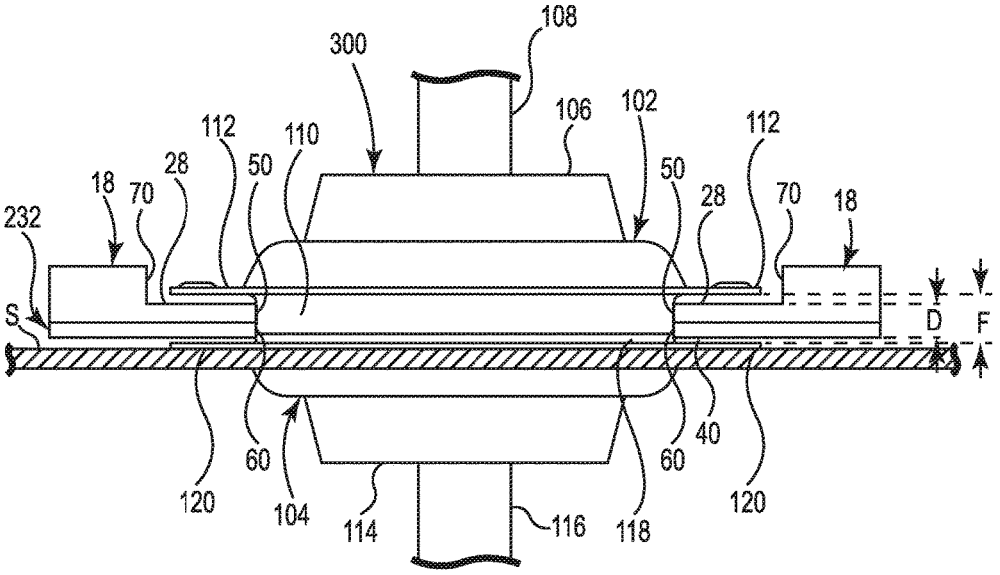
FIGS. 8A and 8B are front views illustrating the de-mating apparatus of FIG. 6 de-mating another electrical connector assembly.
Figure 8B:
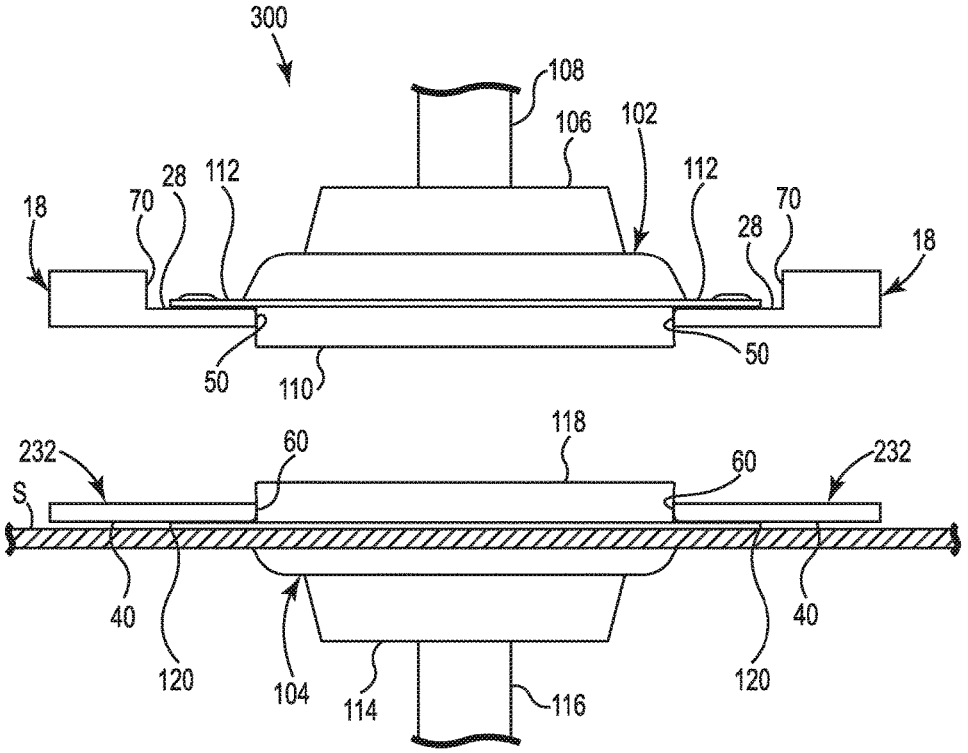

The operation of de-mating apparatus 210 to de-mate an electrical connector assembly connected to a substantially flat surface is illustrated in FIGS. 8A and 8B. FIGS. 8A and 8B are front views illustrating the de-mating apparatus 210 of FIGS. 6 and 7 de-mating an electrical connector assembly 300. For clarity, only the first pair of arms 18 and the second pair of arms 232 of the de-mating apparatus 210 are shown. FIG. 8A shows the de-mating apparatus 210 in the first position in which the first pair of arms 18 is adjacent to the second pair of arms 232 and engaging the electrical connector assembly 300 in a mated condition. FIG. 8B shows the de-mating apparatus 210 in the second position in which the first pair of arms 18 is apart from the second pair of arms 232 and engaging the electrical connector assembly 300 in a de-mated condition.

As shown in FIGS. 8A and 8B, the electrical connector assembly 300 may be identical to the electrical connector assembly 100 described above in reference to FIGS. 3A and 3B, except that socket connector 104 may be mounted to a surface S. The surface S may be, for example, a surface of an electrical panel or a circuit board.

As shown in FIG. 8A, when the de-mating apparatus 210 in the first position in which the first pair of arms 18 is adjacent to the second pair of arms 232, the first lift surface 28 is spaced from the second lift surface 40 by a distance D. The electrical connector assembly 300 in a mated condition has a gap F between the plug retaining flange 112 and the socket retaining flange 120. Gap F may be greater than distance D such that the de-mating apparatus 210 may engage the mated electrical connector assembly 300, as shown in FIG. 8A. So engaged, the first lift surface 28 of one of the first pair of arms 18 and the corresponding second lift surface 40 of the corresponding one of the second pair of arms 232 are interposed directly between the plug retaining flange 112 and the socket retaining flange 120 on one side of the electrical connector assembly 100; and the first lift surface 28 of the other one of the first pair of arms 18 and the corresponding second lift surface 40 of the corresponding other one of the second pair of arms 232 are interposed directly between the plug retaining flange 112 and the socket retaining flange 120 on the opposite side of the electrical connector assembly 300. In some embodiments, gap F may be, for example, about 0.24 to 0.28 inches (6.1 to 7.1 mm) and distance D may be, for example, about 0.18 to 0.22 inches (4.6 to 5.6 mm).

The de-mating apparatus 210 may further engage the mated electrical connector assembly 300 such that the plug tubular shell 110 physically contacts the pair of contact surfaces 50, and/or the socket tubular shell 118 physically contacts the pair of contact surfaces 60. In this way, each of the first lift surfaces 28 and the plug retaining flanges 112; and the second lift surfaces 40 and the socket retaining flanges 120 may present the largest possible area for engagement.

Once engaged, the de-mating apparatus 210 may de-mate the electrical connector assembly 300 as shown in FIG. 8B by moving the first pair of arms 18 from the first position adjacent to the second pair of arms 232 to the second position apart from the second pair of arms 232 as described above for the de-mating apparatus 10 in reference to FIGS. 1A and 1B. Because the pair of linear bearings 44 direct the movement of the first pair of arms 18 in a direction perpendicular to the first lift surfaces 28, and the second lift surfaces 40 may be parallel to the first lift surfaces 28, as describe above in reference to FIGS. 1A and 1B, the force to de-mate the electrical connector assembly 100 may be applied evenly, in a direction parallel to the axis of the plug tubular shell 110 and the socket tubular shell 118, with no rocking of the electrical connector assembly 300.

In the embodiment shown in FIGS. 8A and 8B, it may be the physical contact between the plug tubular shell 110 and the pair of contact surfaces 50, and/or between the socket tubular shell 118 and the pair of contact surfaces 60 that determines the engagement of the de-mating apparatus 210 with the electrical connector assembly 300. The pair of raised edges 70 may provide additional support and visual clues to aid in engaging the de-mating apparatus 210 with the electrical connector assembly 300, but they may not determine the engagement, as there may not be physical contact between edges of the plug retaining flanges 112 and pair of raised edges 70. In other embodiments, it may be the physical contact between edges of the plug retaining flanges 112 and pair of raised edges 70 that determines the engagement of the de-mating apparatus 210 with the electrical connector assembly 300.

The de-mating apparatus embodiments described above solve several problems. The embodiments evenly apply the force to de-mate an electrical connector assembly, and prevent rocking of the electrical connector assembly and any attendant damage to the electrical connector including bent pins, damaged sockets, and scoring of the electrical connector assembly. Embodiments of the de-mating apparatus permit an unobstructed view of an electrical connector assembly during the de-mating process and do not require a technician grab the electrical connector and risk injury. The physical separation between a bearing plane and any of the pairs of arms provides for unfettered passage of wire bundles. Embodiments of the de-mating apparatus may also be able to de-mate electrical connector assemblies of up to five different shell sizes.

In all embodiments described above, the terms parallel, perpendicular, opposite, identical are not intended to be absolutely or perfectly so but rather to be sufficiently so to provide the desired purpose.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

We claim:

1. An apparatus capable of de-mating an electrical connector assembly, the apparatus comprising:

a first component including:

a first pair of arms projecting away from the first component, each of the first pair of arms including a first lift surface; and a third pair of arms on a side of the first component opposite the first pair of arms, the third pair of arms projecting away from the first component, each of the third pair of arms including a third lift surface;

a second component including:

a second pair of arms projecting away from the second component, each of the second pair of arms including a second lift surface, wherein the second lift surfaces are parallel to the first lift surfaces; and a fourth pair of arms on a side of the second component opposite the second pair of arms, the fourth pair of arms projecting away from the second component, each of the fourth pair of arms including a fourth lift surface, wherein the fourth lift surfaces are parallel to the third lift surfaces; and a pair of parallel linear bearings connecting the first component to the second component such that the first pair of arms may move perpendicularly to the first lift surfaces between at least a first position adjacent to the second pair of arms and a second position apart from the second pair of arms, and the third pair of arms may move perpendicularly to the fourth lift surfaces between at least a first position adjacent to the fourth pair of arms and a second position apart from the fourth pair of arms;

wherein a bearing plane defined by the pair of linear bearings does not intersect the first pair of arms or the third pair of arms.

2. The apparatus of claim 1, wherein at least one of the first pair of arms and the second pair of arms further includes a pair of contact surfaces, wherein each of the pair of contact surfaces is disposed on one of the arms and faces toward and is spaced apart from another of the pair of contact surfaces to form a gap between the pair of contact surfaces, and wherein the gap corresponds to a shape of a component of a tubular shell of the electrical connector assembly.

3. The apparatus of claim 1, wherein at least one of the first pair of arms and the second pair of arms further includes a pair of contact surfaces, each of the pair of contact surfaces disposed on one of the arms and facing toward and spaced apart from another of the pair of contact surfaces to form a gap between the pair of contact surfaces, wherein the gap increases in a direction extending perpendicularly from the bearing plane, and the gap at a distance from the bearing plane corresponds to a shape of a component of a tubular shell of the electrical connector assembly.

4. The apparatus of claim 1, wherein at least one of the first pair of arms and the second pair of arms further includes a plurality of pairs of contact surfaces, each of the contact surfaces of a pair of contact surfaces is disposed on one of the the first pair of arms and the second pair of arms, faces toward another of the pair of contact surfaces, and is spaced apart from the other of the pair of contact surfaces to form a gap between the pair of contact surfaces, and wherein each pair of contact surfaces forms a gap corresponding to a component of a tubular shell of an electrical connector assembly having a different shell size.

5. The apparatus of claim 4, wherein at least one of the first pair of arms and the second pair of arms further includes a plurality of pairs of raised edges, each of the pairs of raised edges projecting from the first lift surface or the second lift surface, wherein said each of the pairs of raised edges forms a shape corresponding to a component of a retaining flange of an electrical connector assembly having a different retaining flange size.

6. The apparatus of claim 1, wherein at least one of the first pair of arms and the second pair of arms further includes a raised edge projecting from the first lift surface or the second lift surface, wherein the raised edge forms a shape corresponding to a component of a retaining flange of the electrical connector assembly.

7. The apparatus of claim 1, wherein at least one of the first pair of arms and the second pair of arms further includes a plurality of pairs of raised edges, each of the pairs of raised edges projecting from the first lift surface or the second lift surface, wherein each of the pairs of raised edges forms a shape corresponding to a component of a retaining flange of an electrical connector assembly having a different retaining flange size.

8. The apparatus of claim 1, wherein at least one of the third pair of arms and the fourth pair of arms further includes a plurality of pairs of contact surfaces, each of the contact surfaces of a pair of contact surfaces is disposed on one of the arms, faces toward another of the pair of contact surfaces, and is spaced apart from the other of the pair of contact surfaces to form a gap between the pair of contact surfaces, and wherein each pair of contact surfaces forms a gap corresponding to a component of a tubular shell of an electrical connector assembly having a different shell size.

9. The apparatus of claim 8, wherein at least one of the third pair of arms and the fourth pair of arms further includes a plurality of pairs of raised edges, the pairs of raised edges projecting from the third lift surface or the fourth lift surface, wherein each of the pairs of raised edges forms a shape corresponding to a component of a retaining flange of an electrical connector assembly having a different retaining flange size.

10. The apparatus of claim 1, wherein at least one of the third pair of arms and the fourth pair of arms further includes a plurality of pairs of raised edges, the pairs of raised edges projecting from the third lift surface or the fourth lift surface, wherein each of the pairs of raised edges forms a shape corresponding to a component of a retaining flange of an electrical connector assembly having a different retaining flange size.

11. The apparatus of claim 1, further including a biasing member disposed between the first component and the second component, wherein the biasing member applies a biasing force between the first component and the second component in a direction causing the apparatus to be in the first position.

12. The apparatus of claim 1, further including an adjustable screw for adjusting the biasing force applied by the biasing member.

* * * * *